United States Patent [19]

Minakawa

[11] 4,221,949

[45] Sep. 9, 1980

[54] ABNORMAL TEMPERATURE DETECTION AND MICROWAVE GENERATION SUPPRESSION IN A MICROWAVE OVEN

[75] Inventor: Hiroshi Minakawa, Fujiidera, Japan

[73] Assignee: Sharp Kabushiki Kaisha, Osaka, Japan

[21] Appl. No.: 911,153

[22] Filed: May 31, 1978

[30] Foreign Application Priority Data

May 31, 1977 [JP] Japan ..... 52/65341

[51] Int. Cl.[2] ..... H05B 9/06

[52] U.S. Cl. ..... 219/10.55 C; 219/10.55 R; 219/10.55 B

[58] Field of Search ..... 219/10.55 R, 10.55 B, 219/10.55 C, 10.55 M, 10.55 A

[56] References Cited

U.S. PATENT DOCUMENTS

| | | | |
|---|---|---|---|
| Re. 28,822 | 5/1976 | Fritts | 219/10.55 C |
| 3,875,361 | 4/1975 | Fukui et al. | 219/10.55 B |
| 4,131,779 | 12/1978 | Tatsukawa et al. | 219/10.55 R |
| 4,132,878 | 1/1979 | Tachikawa et al. | 219/10.55 B |

*Primary Examiner*—Arthur T. Grimley

*Attorney, Agent, or Firm*—Birch, Stewart, Kolasch & Birch

[57] ABSTRACT

A hot air exhaustion opening is formed in an oven wall of a microwave oven. A heat-sensitive film is disposed at the hot air exhaustion opening to close the hot air exhaustion opening when the microwave oven is in the normal operation mode. When the oven cavity temperature rises to an abnormal value, the heat-sensitive film is fused to conduct hot air toward the outside of the microwave oven cavity through the hot air exhaustion opening. A heat-sensitive fuse is disposed on the downstream side of the heat-sensitive filter film so that the heat-sensitive fuse receives the hot air exhausted through the hot air exhaustion opening when the heat-sensitive film is fused. The heat-sensitive fuse is associated with a microwave generation control circuit so that the microwave generation is suppressed when the oven cavity temperature rises to the abnormal value.

6 Claims, 7 Drawing Figures

ABNORMAL TEMPERATURE DETECTION AND MICROWAVE GENERATION SUPPRESSION IN A MICROWAVE OVEN

BACKGROUND AND SUMMARY OF THE INVENTION

The present invention relates to a microwave oven and, more particularly, to a microwave generation suppression system in a microwave oven when a microwave oven cavity temperature rises to an abnormal value.

There is the possibility that an oven cavity temperature can rise to an abnormal value due to the combustion of foodstuff or under a no load operation. It is important that the microwave generation be suppressed when the oven cavity temperature rises to an abnormal value.

In the conventional microwave oven, a heat-sensitive fuse is disposed in a power supply circuit for the microwave generation control circuit for suppressing the microwave generation when the oven cavity reaches an abnormally high temperature. In the prior art system the heat-sensitive fuse is disposed on the oven wall, on a wall of an exhaustion duct, or in the oven cavity.

For example, U.S. Pat. No. 3,527,915 entitled "NO LOAD SENSING DEVICE FOR MICROWAVE OVENS", disclosed a microwave oven, on Sept. 8, 1970, wherein the no load sensing theremostat is placed within the cavity of the microwave oven.

The electrical isolation between the heat-sensitive fuse and the microwave oven wall or a duct wall must be strictly performed to ensure stable operation of the microwave oven and the heat-sensitive fuse. The heat-sensitive fuse must be tolerant of high temperature moisture, since the heat-sensitive fuse of the prior art is always exposed to the high temperature moisture. Moreover, it is very difficult in the prior art system to determine the set temperature of the heat-sensitive fuse, because the heat-sensitive fuse is always exposed to the high temperature moisture even when the microwave oven is in the normal condition.

Accordingly, an object of the present invention is to provide a microwave oven wherein microwave generation is suppressed when an oven cavity reaches an abnormally high temperature.

Another object of the present invention is to provide a novel temperature detection system for suppressing microwave generation when an oven cavity reaches an abnormally high temperature.

Still another object of the present invention is to stabilize the operation of a heat-sensitive fuse for detecting the abnormally high temperature of an oven cavity.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a hot air exhaustion opening is formed in an oven wall of a microwave oven in addition to a normal exhaustion opening. A heat-sensitive filter film made of, for example, a polyester film is disposed at the hot air exhaustion opening so as to close the hot air exhaustion opening when the microwave oven is placed in the normal operating mode. When the oven cavity reaches an abnormally high temperature, the heat-sensitive film is fused, thereby conducting hot air toward the outside of the microwave oven cavity through the hot air exhaustion opening.

A heat-sensitive fuse is disposed on the downstream side of the heat-sensitive film so that the heat-sensitive fuse receives and senses the hot air exhausted through the hot air exhaust opening when the heat-sensitive film is fused, that is, only when the oven cavity reaches an abnormally high temperature. The heat-sensitive fuse is associated with a microwave generation control circuit in such a manner that the microwave generation is suppressed when the heat-sensitive fuse is fused.

In a preferred form, the heat-sensitive film becomes fused at about 260° C., and the heat-sensitive fuse is broken at about 115° C. Therefore, when the heat-sensitive film is fused, the heat-sensitive fuse functions to suppress the microwave generation.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
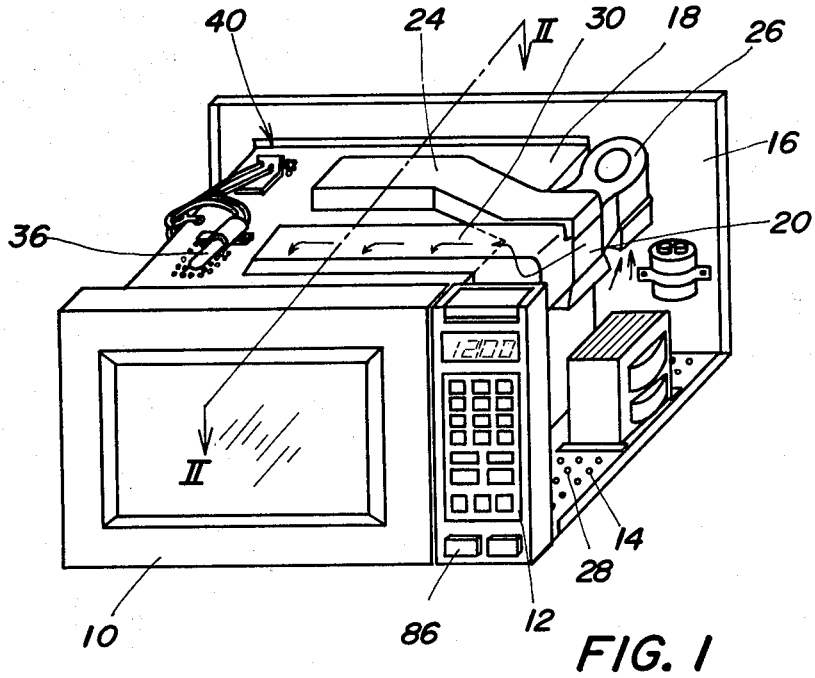
FIG. 1 is an exploded perspective view of a microwave oven employing an embodiment of the abnormal temperature detection system of the present invention.
Figure 2:
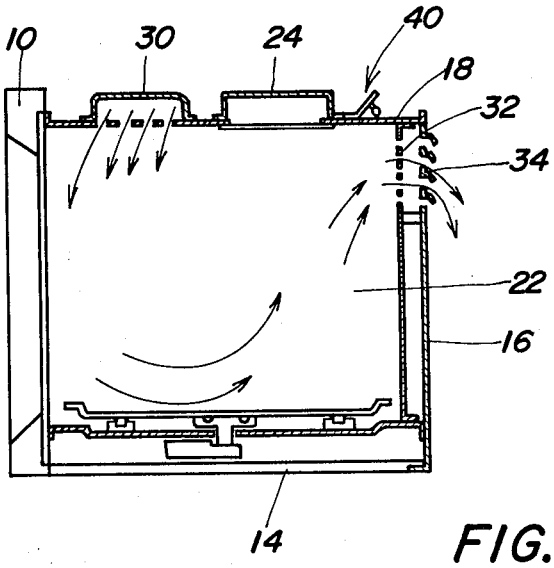
FIG. 2 is a cross-sectional view taken along the line II—II of FIG. 1.

FIGS. 1 and 2 show a microwave oven employing an embodiment of an abnormal temperature detection system of the present invention.

In FIGS. 1 and 2, upper and side casings of the microwave oven are omitted from the drawings for the purpose of simplicity. The microwave oven mainly comprises an oven door 10, a control panel 12, a bottom casing 14, a rear casing 16, and an oven housing 18. A magnetron 20 is supported on the oven housing 18, and the microwave energy developed from the magnetron 20 is introduced into an oven cavity 22 through a waveguide 24. A blower 26 is also supported on the oven housing 18 to recirculate fresh air in the oven cavity 22.

The blower 26 introduces fresh air through openings 28 formed in the bottom casing 14. The thus introduced fresh air is developed from the blower 26 toward an air supply duct 30 through the magnetron 20. Therefore, the magnetron 20 is cooled by the fresh air developed from the blower 26. The thus transferred fresh air is introduced into the oven cavity 22 along the oven door 10 and exhausted, for recirculation purposes, through exhaustion opeings 32 formed in the rear wall of the oven housing 18 and an exhaustion outlet 34 formed in the rear casing 16.

An illumination lamp 36 is disposed on the upper wall of the oven housing 18 in order to illuminate the oven cavity 22. The abnormally high temperature detection system 40 of the present invention is disposed at the upper wall of the oven housing 18.

Figure 3:
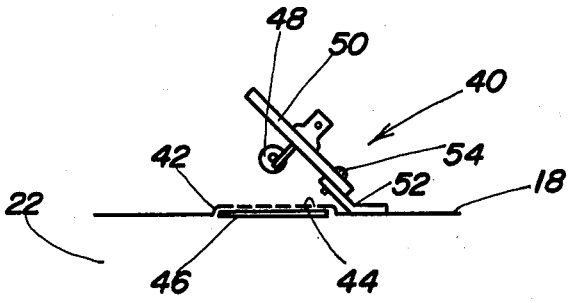
FIG. 3 is a front view of one embodiment of the abnormal temperature detection system of the present invention.
Figure 5:
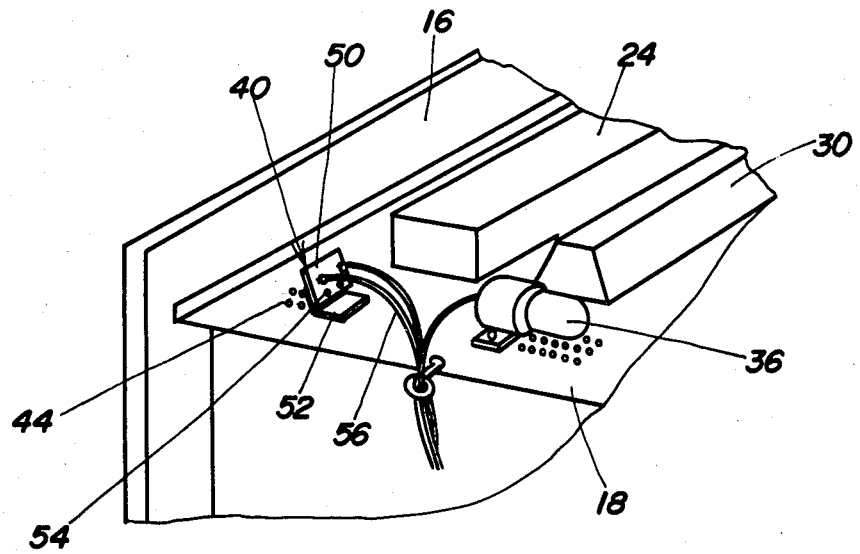
FIG. 5 is a perspective view of a portion of a microwave oven employing the abnormal temperature detection system of FIG. 3.

FIGS. 3 and 5 show an embodiment of the abnormally high temperature detection system 40. Like elements corresponding to those of FIGS. 1 and 2 are indicated by like numerals.

The abnormally high temperature detection system 40 is disposed near the exhaustion openings 32 formed in the rear wall of the oven housing 18. The abnormally high temperature detection system 40 comprises an indent 42 formed in the upper wall of the oven housing 18, openings 44 formed in the indent 42, and a heat-sensitive filter film 46 attached to the indent 42 to close the openings 44. The heat-sensitive filter film 46 is made of a polyester film of 30 mm×30 mm size and 0.05 mm thick. The heat-sensitive filter film 46 is distorted at about 150° C. and fused at about 260° C.

The abnormally high temperature detection system 40 further comprises a heat-sensitive fuse 48 supported by a supporting plate 50, which is fixed to an angle 52 through the use of screws 54. The angle 52 is attached to the upper wall of the oven housing 18 through the use of a spot welding method. The heat-sensitive fuse 48 is supported in such a manner that the heat-sensitive fuse 48 is positioned above the openings 44. The heat-sensitive fuse 48 is in electrical communication with a control circuit of the microwave oven via lead wires 56. The heat-sensitive fuse 48 is constructed so as to fuse at around 115° C.

When the microwave oven is in the normal operation condition, the heat-sensitive fuse 48 does not receive hot air generated from foodstuff disposed within the oven cavity 22, because the oven cavity temperature is held below about 100° C. and the heat-sensitive filter film 46 functions to isolate the heat-sensitive fuse 48 from the oven cavity 22.

When the oven cavity 22 reaches an abnormally high temperature because of defective operation or combustion of the foodstuff disposed within the oven cavity 22, the heat-sensitive filter film 46 is fused at around 260° C., whereby the hot air is exhausted through the openings 44 toward the heat-sensitive fuse 48. The heat-sensitive fuse 48 is thus fused by the hot air, and the microwave generation is suppressed.

Figure 4:
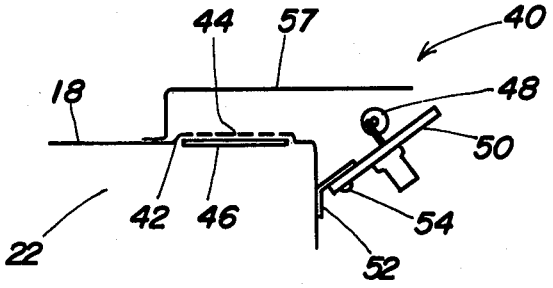
FIG. 4 is a front view of another embodiment of the abnormal temperature detection system of the present invention.
Figure 6:
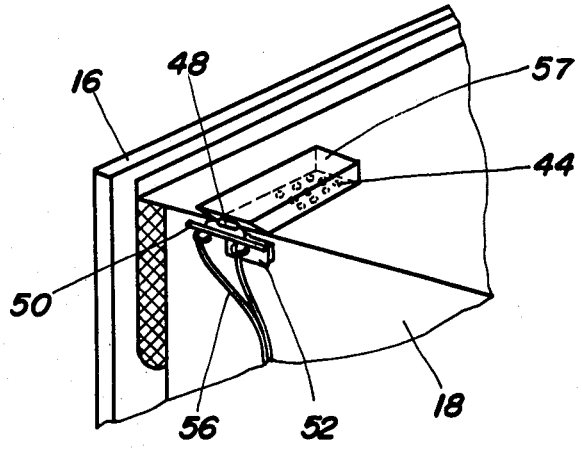
FIG. 6 is a perspective view of a portion of a microwave oven employing the abnormal temperature detection system of FIG. 4.

FIGS. 4 and 6 show another embodiment of the abnormally high temperature detection system 40. Like elements corresponding to those of FIGS. 3 and 5 are indicated by like numerals.

The heat-sensitive fuse 48 is fixed to a side wall of the oven housing 18. A duct 57 is attached to the upper wall of the oven housing 18 through the use of a spot welding method so that the hot air is conducted toward the heat-sensitive fuse 48 when the heat-sensitive filter film 46 is fused.

Figure 7:
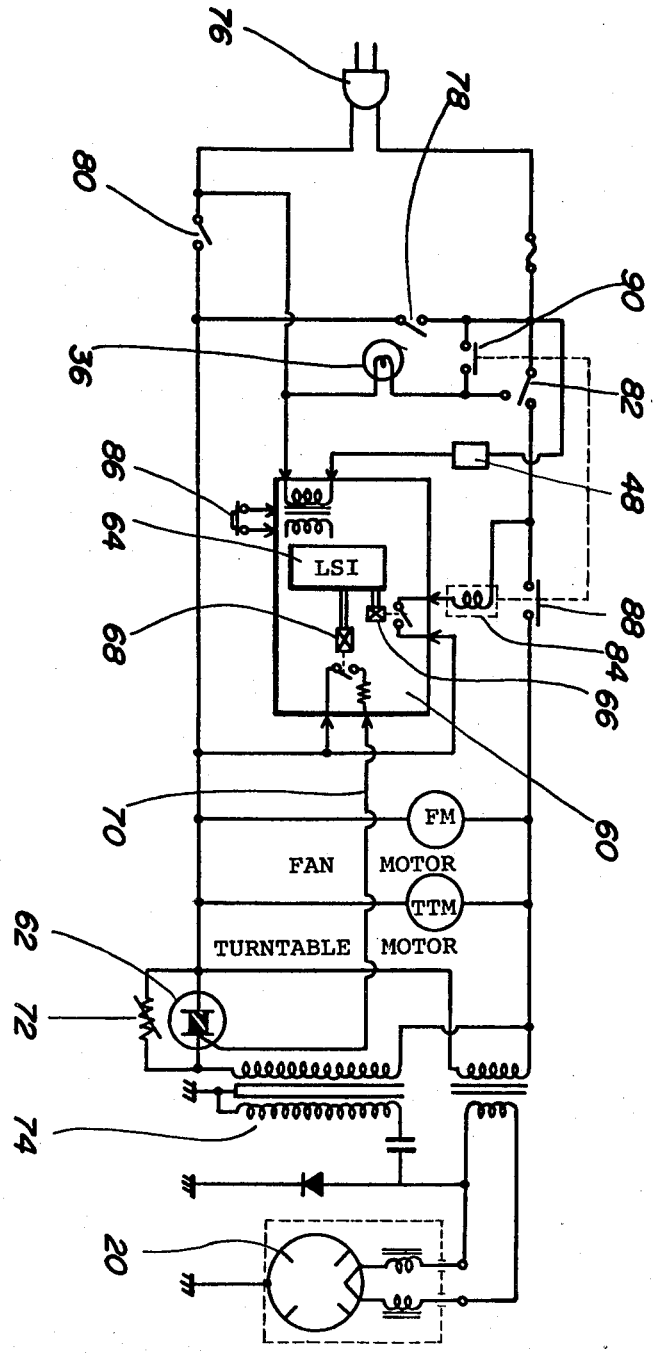
FIG. 7 is a circuit diagram of a control circuit of the microwave oven of FIG. 1.

FIG. 7 shows the control circuit of the microwave oven.

The control circuit mainly comprises a control unit 60, a triac 62, and a microwave generation circuit including the magnetron 20. The control unit 60 comprises an LSI 64, and two relays 66 and 68 controlled by the LSI 64. The relay 66 controls the power supply, and the relay 68 controls a current flow of a gate line 70 to control the microwave generation. That is, a gate signal developed from the control unit 60 is applied to the triac 62 through the gate line 70 to control the microwave generation of the magnetron 20. The triac 62, in combination with a varister 72, controls a current flow to a primary winding of a high voltage transformer 74.

The control circuit further comprises a plug 76 for receiving commerical power supply, a monitor switch 78 which is mechanically placed in its OFF condition when the oven door is closed and is mechanically placed in its ON condition when the oven door is opened, and a primary interlock switch 80 and a secondary interlock switch 82 which are mechanically placed in the ON condition when the oven door is closed and are mechanically placed in the OFF condition when the oven door is opened. That is, the interlock switches 80 and 82 function to allow the power supply to the remaining portions of the circuit only when the oven door is closed.

A timer for cooking is set at a desired value through the use of touch keys included within the control panel 12. When a coil 84 of a cook relay is energized by the relay 66 which is closed by a start switch 86 on the control panel 12, the energization is held and functions to close relay contacts 88 and 90. When the relay contact 90 is closed, the illumination lamp 36 is enabled. When the relay contact 88 is closed, a current path to the high voltage transformer 74 is established.

The heat-sensitive fuse 48 is installed between the control unit 60 and the power supply plug 76. That is, when the heat-sensitive fuse 48 is fused, the control unit 60 is not power supplied and, therefore, the microwave generation is suppressed.

As discussed above, in accordance with the present invention, the electrical insulation of the heat-sensitive fuse is not strictly required, since the heat-sensitive fuse is placed outside of the oven cavity and the heat-sensitive fuse does not receive the hot air in the normal operation condition. The temperature detection is stable, because the heat-sensitive filter film is located within the oven cavity. The operation of the heat-sensitive fuse is stable and rapid, because the heat-sensitive fuse receives the hot air only when the oven cavity reaches the abnormally high temperature.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A microwave oven comprising a microwave oven housing for defining an oven cavity, a microwave generation means for applying microwave energy to a material disposed within said oven cavity, and an abnormally high temperature detection system for suppressing microwave generation when said oven cacity reaches an abnormally high temperature, said abnormally high temperature detection system comprising:

a hot air exhaustion opening formed in a wall of said oven housing;

a heat-sensitive film attached to said hot air exhaustion opening to close said hot air exhaustion opening, said heat-sensitive film being fusible when said oven cavity reaches an abnormally high temperature in order to open said hot air exhaustion opening;

a heat-sensitive fuse disposed outside of said oven cavity and at a position near said hot air exhaustion opening; and a control circuit means for suppressing the microwave generation when said heat-sensitive fuse is fused.

2. The microwave oven of claim 1, wherein said hot air exhaustion opening is formed in an upper wall of said oven housing, and said heat-sensitive fuse is fixed to the upper surface of said upper wall of said oven housing.

3. The microwave oven of claim 1 or 2, wherein said heat-sensitive film comprises a polyester film.

4. The microwave oven of claim 3, wherein said polyester film has a thickness of about 0.05 mm.

5. The microwave oven of claim 3, wherein said polyester film is fusible at about 260° C.

6. The microwave oven of claim 5, wherein said heat-sensitive fusible is fused at about 115° C.

* * * * *